United States Patent [19]

Jolicoeur et al.

[11] Patent Number: 5,045,238

[45] Date of Patent: Sep. 3, 1991

[54] HIGH ACTIVE DETERGENT PARTICLES WHICH ARE DISPERSIBLE IN COLD WATER

[75] Inventors: John M. Jolicoeur; Frank J. Mueller, both of Cincinnati, Ohio

[73] Assignee: The Procter & Gamble Company, Cincinnati, Ohio

[21] Appl. No.: 364,732

[22] Filed: Jun. 9, 1989

[51] Int. Cl.[5] ..... C11D 11/00; C11D 1/14; C11D 1/83

[52] U.S. Cl. ..... 252/550; 252/89.1; 252/174; 252/174.21; 252/174.22; 252/174.23

[58] Field of Search ..... 252/368, 369, 370, 174, 252/550, 552, 174.23, 174.21, 174.22, 89.1

[56] References Cited

U.S. PATENT DOCUMENTS

| | | | |
|---|---|---|---|
| 3,434,974 | 3/1969 | Austin et al. | 252/550 |
| 3,726,813 | 4/1973 | Borello | 252/539 |
| 4,162,994 | 7/1979 | Kowalcheck | 252/532 |
| 4,248,911 | 2/1981 | Wixon | 427/214 |
| 4,260,651 | 4/1981 | Wixon | 427/214 |
| 4,339,335 | 7/1982 | Wixon | 252/8.8 |
| 4,347,152 | 8/1982 | Wixon | 252/174 |
| 4,411,809 | 10/1983 | Wixon | 252/91 |
| 4,482,470 | 11/1984 | Reuter et al. | 252/162 |
| 4,515,707 | 5/1985 | Brooks | 252/368 |
| 4,637,891 | 1/1987 | Delwel et al. | 252/135 |
| 4,666,728 | 5/1987 | Wixon | 427/214 |
| 4,666,740 | 5/1987 | Wixon | 427/214 |
| 4,695,284 | 9/1987 | Hight | 8/137 |
| 4,715,979 | 12/1987 | Moore et al. | 252/91 |
| 4,925,585 | 5/1990 | Strauss et al. | 252/89.1 |

FOREIGN PATENT DOCUMENTS

| | | |
|---|---|---|
| 0080222 | 6/1983 | European Pat. Off. . |
| 0110731 | 6/1984 | European Pat. Off. . |
| 253323 | 1/1988 | European Pat. Off. . |
| 266847A | 5/1988 | European Pat. Off. . |
| 60-135498 | 12/1983 | Japan . |
| 60-72999 | 4/1985 | Japan . |
| 61-69897 | 4/1986 | Japan . |
| 61-69898 | 4/1986 | Japan . |
| 61-69900 | 4/1986 | Japan . |
| 61-118500 | 6/1986 | Japan . |
| 61-272300 | 12/1986 | Japan . |
| 62-240397 | 10/1987 | Japan . |
| 62-253699 | 11/1987 | Japan . |
| 63-92699 | 4/1988 | Japan . |
| 63-154799 | 6/1988 | Japan . |
| 63-1999797 | 8/1988 | Japan . |
| 62-228000 | 10/1988 | Japan . |

OTHER PUBLICATIONS

Pending U.S. patent application Ser. No. 364,725, Jolicoeur, Filed Jun. 9, 1989.

Pending U.S. patent application Ser. No. 364,721, Mueller et al., Filed Jun. 9, 1989.

*Primary Examiner*—Paul Lieberman
*Assistant Examiner*—A. Beadles-Hay
*Attorney, Agent, or Firm*—Kathleen M. Harleston; Donald E. Hasse; Thomas J. O'Flaherty

[57] ABSTRACT

This is a process for making high active alkyl sulfate particles which are dispersible in cool or cold water. The process includes applying mechanical work to low moisture, neutralized $C_{12-18}$ alkyl sulfate paste. Included are detergent particles made by this process and a method for washing fabrics at cool or cold water temperatures using detergent particles made by this process.

14 Claims, No Drawings

HIGH ACTIVE DETERGENT PARTICLES WHICH ARE DISPERSIBLE IN COLD WATER

FIELD OF THE INVENTION

The present invention relates to a process for making high active detergent particles. More particularly, it relates to a process for making high active detergent particles which are dispersible in cool or cold water, which includes producing a low moisture, neutralized alkyl sulfate paste and applying mechanical work to the paste. Included are detergent particles made by this process and a method for washing fabrics in cool or cold water using detergent particles made by this process.

BACKGROUND OF THE INVENTION

High active detergent particles for inclusion in concentrated detergent products can be made by various known processes. One method is dilute neutralization of the surfactant acid with caustic followed by drying to low moisture to make a concentrated paste which can be formed into high active particles.

Another way is to use a continuous neutralization system such as a continuous neutralization loop. Concentrated (about 50% solids) caustic and the surfactant acid can be separately added to a continuous neutralization loop, where neutralization takes place. The resulting low moisture surfactant paste from the loop can be cooled and made into high active detergent granules by, for example, extrusion.

The art discloses some ingredients which can be added to improve cold water dispersibility. For example, Japanese Patent 63-199797, Nakamura et al., laid open Aug. 18, 1988, describes a high density granular detergent composition to which a certain amount of water-soluble and crystalline salts are added to improve cold water dispersibility.

In European Patent Application 0 080 222, Barford, published June 6, 1983, the granular detergent compositions comprise a non-soap anionic surfactant and a water-soluble anionic polymer in intimate admixture and a water-soluble neutral or alkaline salt. The compositions exhibit an improved speed of solubility.

Cold water washing is addressed by U.S. Pat. No. 4,695,284, Hight, issued Sep. 22, 1987, which discloses built detergent particles comprising nonionic surfactant, saturated fatty acid builder salt and carrier material.

Japanese Patent 6222800 claims a solubility improvement by coating granular detergent particles with fine powders and regulating particle size.

It has heretofore been difficult to make high active alkyl sulfate particles which are dispersible under cool or cold water washing conditions.

SUMMARY OF THE INVENTION

The instant invention presents high active detergent particles made from concentrated alkyl sulfate paste which are dispersible in cool or cold water because mechanical work has been applied to the paste before particle formation. Certain salts, coatings, or other added ingredients are not necessary for improved dispersibility. Good cool or cold water dispersibility is obtained without adding extra ingredients. Extra ingredients are often not desirable because they may decrease the amount of detergent surfactant which can be incorporated into the particles and may complicate and add expense to the process of making the particles.

The present invention relates to a process for making high active detergent particles which are dispersible in cold water, comprising:

(a) producing a neutralized $C_{12-18}$ alkyl sulfate paste having less than about 14 weight % water and less than about 20 weight % additional ingredients;

(b) applying mechanical work to the paste while maintaining the paste at temperatures between about 10° C. and 45° C.;

(c) forming detergent particles from the worked paste;

the mechanical work being applied in an amount sufficient to make the particles substantially disperse after agitation for about 10 minutes in water with a temperature between about 4° C. and 30° C.

DESCRIPTION OF THE INVENTION

This invention includes a process for making high active detergent particles which are dispersible in cool or cold water, detergent particles made by this process, and a method for washing fabrics at cool or cold water temperatures with such detergent particles.

The high active detergent particles are preferably from about 50 to 100 weight % active, more preferably from about 60 to 85 weight % active, most preferably from about 70 to 75 weight % active. They are comprised of neutralized $C_{12-18}$ alkyl sulfate paste having less than about 14 weight % water and less than about 20 weight % of additional ingredient(s).

The high active detergent particles of this invention are dispersible in cool or cold water, meaning that they are substantially dispersed in water at a temperature between about 4° C. and 30° C., preferably between about 5° C. and 20° C., most preferably between about 10° C. and 15° C.

A. Alkyl Sulfate Paste

The first step in this process for making high active detergent particles which are dispersible in cold water is producing a neutralized $C_{12-18}$ alkyl sulfate paste having less than about 14 weight % water and less than about 20 weight % additional ingredients.

1 Paste Production

The neutralized $C_{12-18}$ alkyl sulfate paste, preferably neutralized $C_{14-16}$ alkyl sulfate paste, can be produced by dilute neutralization of $C_{12-18}$ (preferably $C_{14-16}$) alkyl sulfuric acid with alkali metal hydroxide solution followed by drying to low moisture to make a concentrated paste which can be formed into high active particles. However, the $C_{12-18}$ alkyl sulfate paste is preferably produced in a continuous neutralization system, for example a continuous neutralization loop (available from The Chemithon Corporation, Seattle, Wash.). In a continuous neutralization loop, alkyl sulfuric acid and concentrated metal hydroxide solution (greater than about 50% by weight of the hydroxide) are separately added to the loop, where neutralization takes place. The resulting low moisture, neutralized alkyl sulfate paste from the loop can be cooled and made into high active detergent granules by, for example, extrusion. For this invention, alkali metal hydroxide solution, preferably sodium hydroxide, greater than or equal to about 62 weight % hydroxide is preferred because the resulting neutralized alkyl sulfate paste will ordinarily contain less than about 14 weight % water. Less water in the paste corresponds to higher activity in the final detergent particles. This is desirable because the final detergent particles are preferably used in a concentrated laundry detergent composition. It is most preferred that the alkali metal hydroxide be about 70 weight % hydroxide.

The $C_{12-18}$ alkyl sulfuric acid for use in making the alkyl sulfate paste preferably is made by a sulfonation process using $SO_3$ in a falling film reactor. See *Synthetic Detergents.* 7th ed., A. S. Davidson & B. Milwidsky, John Wiley & Sons, Inc., 1987, pp. 151-168.

During addition of the concentrated alkali metal hydroxide solution to the continuous neutralization loop, care must be taken to avoid "cold spots" in the loop. A "cold spot" is any point in the feed system, pumps, metering systems, pipes or valves of the loop with a temperature below the melting point of the concentrated caustic solution (155° F. or 68.3° C. for 70% caustic, for example). Such a "cold spot" can cause crystallization of the caustic and blockage of the system. Typically "cold spots" are avoided by hot water jackets, electrical tracing, and electrically heated enclosures.

The alkali metal hydroxide is preferably present in slight excess of the stoichiometric amount necessary to neutralize the alkyl sulfuric acid. If reserve alkalinity (excess caustic) in the continuous neutralization system exceeds about 1.5% $M_2O$ (where M is metal), the paste is difficult to circulate through the continuous neutralization system because of its high viscosity. If reserve alkalinity drops below about 0.1%, the alkyl sulfate paste may not be stable long term because of hydrolysis. It is therefore preferred that reserve alkalinity, which can be measured by titration with acid, of the paste in the neutralization system be between about 0.1% and 1.5%, more preferably between about 0.2% and 1.0%, most preferably between about 0.3% and 0.7%.

The alkyl sulfuric acid and alkali metal hydroxide solution are put into the continuous neutralization loop separately, preferably at a high shear mixer in the neutralization loop so that they mix together as rapidly as possible.

Generally, in a continuous neutralization loop the ingredients enter the loop through a pump (typically centrifugal) which circulates the material through a heat exchanger in the loop and back through the pump, where new materials are introduced. The material in the loop continually recirculates, with as much product exiting as is entering. Product exits through a control valve, which is usually after the pump. The recirculation rate of a continuous neutralization loop is between about 1:1 and 50:1. The temperature of the neutralization reaction can be controlled to a degree by adjusting the amount of cooling by the heat exchanger. The "throughput" can be controlled by modifying the amount of alkyl sulfuric acid and alkali metal hydroxide solution introduced.

2. Paste Moisture Content •

The neutralized $C_{12-18}$ alkyl sulfate paste of this invention should have less than about 14, preferably from about 8 to 12, weight % water. This is because mechanical work applied to neutralized $C_{12-18}$ alkyl sulfate paste with more than about 14 weight % water apparently does not yield the dispersibility improvement seen for product with moisture levels less than about 14 (see Example III).

3. Additional Paste Ingredients

In addition to having less than about 14 weight % water, the neutralized $C_{12-18}$ alkyl sulfate paste of this invention has less than about 20 weight %, preferably less than about 15 weight %, additional ingredients. It is preferred that this additional ingredient be selected from the group consisting of polyethylene glycol of a molecular weight between about 4,000 and 50,000 (more preferably between about 7,000 and 50,000, most preferably between about 7,000 and 12,000); ethoxylated nonionic surfactant of the formula $R(OC_2H_4)_nOH$, wherein R is a $C_{12-18}$ alkyl group or a $C_{8-16}$ alkyl phenol group and n is from about 9 to about 80, with a melting point of greater than about 48° C.; and mixtures thereof. From about 5 to 10 weight % polyethylene glycol of a molecular weight between about 4,000 and 50,000 is preferred. More preferred is from about 5 to 10 weight % polyethylene glycol of a molecular weight between about 7,000 and 12,000 and most preferred is polyethylene glycol of molecular weight 8000 ("PEG 8000").

The polyethylene glycol and/or the ethoxylated nonionic surfactant is preferably added separately or as a mixture to the continuous neutralization system. They preferably enter the continuous neutralization loop after a high shear mixer and before the recirculation pump. They should be melted before addition to the continuous neutralization system, so that they can be metered in. A more complete description of this aspect of the process is found in the copending U.S. patent application of Frank J. Mueller and Lester J. Hollihan, filed concurrently herewith on June 9, 1989.

These polyethylene glycols and ethoxylated nonionic surfactants are preferred because they enhance detergency performance and are solid at below about 48° C., so that a detergent particle which is firm at ambient temperature can be made from the neutralized product. They also act as a process aid by reducing the viscosity of the high active paste in the continuous neutralization loop.

Polyethylene glycol is formed by the polymerization of ethylene glycol with ethylene oxide in an amount sufficient to provide a compound with a molecular weight between about 4,000 and 50,000. It can be obtained from Union Carbide (Danbury, Conn.).

The preferred ethoxylated nonionic surfactant material is of the formula $R(OC_2H_4)_nOH$, wherein R is a $C_{12-18}$ alkyl group and n is from about 12 to about 30. Most preferred of these is tallow alcohol ethoxylated with 18 moles of ethylene oxide per mole of alcohol ("TAE 18"). The preferred melting point for the ethoxylated nonionic surfactant is greater than about 60° C.

Examples of other ethoxylated nonionic surfactants herein are the condensation products of one mole of decyl phenol with 9 moles of ethylene oxide, one mole of dodecyl phenol with 16 moles of ethylene oxide, one mole of tetradecyl phenol with 20 moles of ethylene oxide, or one mole of hexadecyl phenol with 30 moles of ethylene oxide.

Other additional ingredients suitable for inclusion in detergent particles may be added to the neutralized $C_{12-18}$ alkyl sulfate paste as long as they do not interfere with the effect of the mechanical work. If ingredients other than polyethylene glycol and ethoxylated nonionic surfactant are to be added, it is preferred that levels be kept below about 10 weight %, most preferably less than about 5 weight %. Examples of additional ingredients which may be included are water-soluble detergent builders, suds boosters or suds suppressors, anti-tarnish and anticorrosion agents, soil suspending agents, soil release agents, germicides, pH adjusting agents, non-builder alkalinity sources, chelating agents, smectite clays, enzyme-stabilizing agents and perfumes See U.S. Pat. No. 3,936,537, issued Feb. 3, 1976 to Baskerville, Jr. Et al., incorporated herein by reference. Bleaching agents and activators are described in U.S. Pat. No. 4,412,934, Chung et al., issued Nov. 1, 1983, and in U.S. Pat. No. 4,483,781, Hartman, issued Nov. 20, 1984, both of which are incorporated herein by reference.

Builders are generally selected from the various water-soluble, alkali metal, ammonium or substituted ammonium phosphates, polyphosphates, phosphonates, polyphosphonates, carbonates, silicates, borates, polyhydroxy sulfonates, polyacetates, carboxylates, and polycarboxylates. Preferred are the alkali metal, especially sodium, salts of the above.

Additional ingredients in amounts/combinations known to improve cool or cold water dispersibility preferably are not included in the neutralized alkyl sulfate paste because they are unnecessary. The instant process provides a way to make high active alkyl sulfate particles dispersible in cold water without adding those extra ingredients known to improve dispersibility.

As in most chemical processes, there are some by-products from the processes involved. First, it is likely that from 0 to about 6 weight %, usually about 3 to 4 weight %, unreacted material will be in the neutralized paste and therefore in the final detergent particles. This material is from the sulfonation reaction in the falling film reactor, which is where the $C_{12-18}$ alkyl sulfuric acid is made. The unreacted material is the $C_{12-18}$ fatty alcohol that did not react with the $SO_3$.

Second, from 0 to about 6 weight %, usually about 1 to 3 weight %, of the neutralized paste and therefore the final detergent particles is sulfate which is formed by a reaction of the metal hydroxide with $SO_3$ carried to the continuous neutralization loop in the alkyl sulfuric acid from the falling film reactor.

Third, from 0 to about 6 weight %, usually about 0.5 to 1.2 weight %, of the neutralized $C_{12-18}$ alkyl sulfate paste is metal hydroxide, preferably sodium hydroxide, from the reaction in the continuous neutralization loop between the metal hydroxide solution and the $C_{12-18}$ alkyl sulfuric acid. (See reserve alkalinity discussion above.)

4. Equipment Modifications

If a continuous neutralization loop is used to produce the neutralized $C_{12-18}$ alkyl sulfate paste, the loop should be modified as follows to accommodate the concentrated (≧62% by weight of the hydroxide) alkali metal solution and the polyethylene glycol and/or ethoxylated nonionic surfactant:

(1) Insulate the loop;
(2) Change the centrifugal pump to a positive displacement pump, which is better able to handle very viscous material;
(3) Install a caustic feed system which can handle the concentrated alkali metal hydroxide solution;
(4) Introduce materials through a high shear mixer installed in-line;
(5) Install a metering system for the polyethylene glycol and/or ethoxylated nonionic surfactant, preferably after the high shear mixer;
(6) Position the incoming streams of acid and caustic at the high shear mixer so that the highest degree of mixing possible takes place;
(7) Keep the temperature of the loop sufficiently high to maintain the lowest possible viscosity of the paste to insure adequate recirculation and mixing. Typical paste temperatures in the loop are between about 180° F. (82.2° C.) and 230° F. (110° C.), preferably about 200° F. (93.3° C.) to 210° F. (98.9° C.).

B. Mechanical Work

The second step in the instant process is applying mechanical work to the neutralized $C_{12-18}$ alkyl sulfate paste in an amount sufficient to make particles made from the paste substantially disperse after agitation for about 10 minutes in water with a temperature between about 4° C. and 30° C., preferably between about 5° C. and 20° C., and most preferably about 15° C.

Dispersibility of particles made from neutralized $C_{12-18}$ alkyl sulfate paste varies according to the carbon chain length of the alkyl sulfate, water temperature, and water hardness. Alkyl sulfate of shorter carbon chain length disperses more readily than alkyl sulfate of longer carbon chain length, but the latter generally cleans better than the former. As would be expected, dispersibility decreases as water temperatures decrease. At cold temperatures between about 4° C. and 30° C., there is a dispersibility problem, especially with the desirable $C_{14-16}$ carbon chain alkyl sulfate particles. The instant invention improves alkyl sulfate particle dispersibility, even for longer carbon chain lengths in cold water temperatures.

Lastly, alkyl sulfate, especially of longer carbon chain length, is sensitive to hardness levels in the water. In hard water, i.e. more than about 12 grains per gallon in the United States, dispersibility of $C_{12-18}$ alkyl sulfate particles is a greater problem than at hardness levels of from about 5 to 7 grains per gallon. Likewise, dispersibility at about 5 to 7 grains per gallon is a greater problem than in soft water, i.e. fewer than about 5 grains per gallon.

Just as dispersibility depends on certain factors, the amount of mechanical work needed to improve dispersibility depends on certain factors. These include the amount of water and carbon chain length of the alkyl sulfate product, the additional ingredients in and temperature of the alkyl sulfate product, the type of mechanical work, and the expected use conditions of the particles (water temperatures and water hardness). Regarding the first of these factors, Example III shows that as moisture levels in the alkyl sulfate paste increase, the benefit gained from mechanical work decreases.

Particles containing high levels of alkyl sulfate of a higher carbon chain length ($C_{18}$, for example) are less easily dispersed than particles containing alkyl sulfate of a lower chain length ($C_{12}$, for example). Also, the higher the temperature of the wash water, the more readily the alkyl sulfate-containing particles will disperse For example, particles comprising about 70–75 weight % $C_{14-15}$ alkyl sulfate will not disperse after about 10 minutes of agitation unless the water temperature is at least about 80° F. (26.6° C.). When the $C_{14-15}$ alkyl sulfate paste is mechanically worked, particles made from that paste have a minimum dispersion water temperature of about 40° F. (14.4° C.) after about 10 minutes of agitation.

Regarding the third factor, generally, a lower percentage of additional ingredients (especially powders) is better because there will be less dilution of the paste with non-surfactant. High active, dispersible alkyl sulfate particles can later be admixed with additional ingredients if desired. Additional ingredients in the paste, though, are unnecessary and may complicate the process. However, from about 5 to 10 weight % of the polyethylene glycol (and/or ethoxylated nonionic surfactant) specified herein is preferred and does not interfere with the mechanical work applied to the alkyl sulfate paste.

The amount and type of mechanical work applied to the alkyl sulfate paste affects dispersibility of the particles in cool or cold water. Generally, the dispersibility improvement is directly proportional to the amount of mechanical work applied, until a plateau is reached when more work does not bring improvement. It is preferred that the mechanical work be done by a roll mill, extruder, soap plodder, or combination thereof. A roll mill or extruder is most preferred.

In a roll mill, mechanical work takes place as the paste is forced through the nip between the rolls. The extruder works the paste by forcing it out through a plate with a multiple of small orifices. A soap plodder mixes and extrudes the paste. One particular type of extruder which is similar to a soap plodder and is suitable for use herein is a Teledyne-Readco Continuous Processor ®.

If a three roll mill is used on $C_{14-16}$ alkyl sulfate product which is about 70 to 75% active, from one to three passes are preferred. It is preferred that a three roll mill with the following settings be used: roll temperatures between about 20° C. and 27° C., roll revolutions per minute about 20, 40, and 60, and final roll clearance between about 0.004 and 0.008 inches (0.1 and 0.2 mm, respectively). Under these conditions, it is preferred that paste temperature be kept between about 25° C. and 35° C.

If an extruder is used on $C_{14-16}$ alkyl sulfate product which is about 70 to 75% active, from about four to six passes on a ram piston extruder with an extruder plate having 1 mm openings are preferred.

Lastly, more mechanical work will be needed if expected use conditions involve hard water, i.e. greater than about 12 grains per gallon, and very cold water temperatures, i.e. between about 4° C. and 10° C.

Herein, dispersibility is measured using a Black Fabric Deposition Test. The particles made from the $C_{12-18}$ alkyl sulfate paste are most preferably considered to be dispersible when they receive a rating of between seven and ten on the Black Fabric Deposition Test after being sieved through 14 on 65 Tyler mesh and agitated for about 10 minutes in about 15° C. water of about 7 grains per gallon of hardness. To perform the Black Fabric Deposition Test, room temperature $C_{12-18}$ alkyl sulfate paste is ground, for example by a Cuisinart ®, and sieved through 14 on 65 Tyler mesh to filter out the large and fine particles. An amount of the particles roughly equivalent to the amount of granular detergent recommended for U.S. washing machines is added to the appropriate amount of water. A Tergotometer ® or mini-washer is preferred for ease of use. The wash water has a temperature of about 60° F.(15.5° C.) and a hardness of about 7 grains per gallon. The water containing the particles is agitated for ten minutes. The wash solution is then filtered through a 3½ inch diameter circle of black fabric. The fabric samples are dried and graded on a 1 to 10 scale by panelists (blind test) according to the amount of deposition. Test results may vary ½ grade. A grade of 10 reflects no visible specks of product remaining on the black fabric and therefore excellent dispersibility of the particles in the 60° F. (15.5° C.) water. Only a few particles have been deposited on the black fabric samples receiving a grade of 9, indicating very good dispersibility, and so forth down the scale.

C. Alkyl Sulfate Paste Temperature

The alkyl sulfate paste is maintained at temperatures between about 10° C. and 45° C., preferably between about 15° and 40° C., while applying the mechanical work. The beneficial effect of the mechanical work appears to be inversely proportional to the temperature of the alkyl sulfate paste while it is being worked. Without meaning to be bound by theory, it is believed that the mechanical work on alkyl sulfate paste in this temperature range modifies crystallinity, making particles made from the paste more dispersible in water.

D. Detergent Particles

Lastly, detergent particles are formed from the alkyl sulfate paste which has been mechanically worked. This can be done by any conventional granulation process, preferably by grinding or extrusion after the worked alkyl sulfate paste has been allowed to come to room temperature.

Detergent particles made according to this process comprise $C_{14-16}$ alkyl sulfate paste having less than about 14 weight % water and less than about 20 weight % additional ingredients. Detergent particles made by this process preferably are comprised of:

(a) from about 60 to 85 weight % neutralized $C_{12-18}$ alkyl sulfate;
(b) less than about 14 weight % water;
(c) less than about 20 weight % additional ingredients, more preferably polyethylene glycol of a molecular weight between about 4,000 and 50,000; ethoxylated nonionic surfactant of the formula $R(OC_2H_4)_nOH$, wherein R is a $C_{12-18}$ alkyl group or a $C_{8-16}$ alkyl phenol group and n is from about 9 to about 80, with a melting point of greater than or equal to about 120° F. (48.9° C.); and mixtures thereof.

Detergent particles made by this process more preferably are comprised of:

(a) from about 70 to 75 weight % sodium $C_{14-16}$ alkyl sulfate;
(b) from about 8 to 12 weight % water;
(c) from about 5 to 10 weight % polyethylene glycol of a molecular weight between about 4,000 and 50,000, most preferably between about 7,000 and 12,000.

It is most preferred that detergent particles made by this process comprise or, alternatively, consist essentially of:

(a) from about 70 to 75 weight % sodium $C_{14-16}$ alkyl sulfate;
(b) from about 8 to 12 weight % water;
(c) from about 5 to 10 weight % polyethylene glycol with a molecular weight between about 7,000 and 12,000;
(d) from 0 to about 6 weight % sodium hydroxide;
(e) from 0 to about 6 weight % unreacted material; and
(f) from 0 to about 6 weight % sulfate;

wherein the total of (c)+(d)+(e)+(f) is less than about 20 weight %, most preferably less than about 15 weight %.

This invention also includes a method for washing fabrics at water temperatures between about 4° C. and 30° C. with high active detergent particles, said particles comprising:

(a) from about 60 to 85 weight % neutralized $C_{12-18}$ alkyl sulfate;
(b) less than about 14 weight % water;
(c) less than about 20 weight % additional ingredients, preferably polyethylene glycol of a molecular weight between about 4,000 and 50,000; ethoxylated nonionic surfactant of the formula $R(OC_2H_4)_nOH$, wherein R is a $C_{12-18}$ alkyl group or a $C_{8-16}$ alkyl phenol group and n is from about 9 to about 80, with a melting point of greater than or equal to about 120° F. (48.9° C.); and mixtures thereof.

These particles are preferably made according to the process described above.

Preferred is a method for washing in fabrics at water temperatures between about 4° C. and 20° C., most preferably between about 10° C. and 15° C., with high active detergent particles, said particles comprising:

(a) from about 70 to 75 weight % sodium $C_{14-16}$ alkyl sulfate;

(b) from about 8 to 12 weight % water;

(c) from about 5 to 10 weight % polyethylene glycol of a molecular weight between about 4,000 and 50,000, preferably between about 7,000 and 12,000.

These particles are preferably made according to the process described above.

Most preferred is a method for washing fabrics at water temperatures between about 10° C. and 15° C., with high active detergent particles, said particles comprising or, alternatively, consisting essentially of:

(a) from about 70 to 75 weight % sodium $C_{14-16}$ alkyl sulfate;

(b) from about 8 to 12 weight % water;

(c) from about 5 to 10 weight % polyethylene glycol of a molecular weight between about 7,000 and 12,000;

(d) from 0 to about 6 weight % sodium hydroxide;

(e) from 0 to about 6 weight % unreacted material; and (f) from 0 to about 6 weight % sulfate;

wherein the total of (c)+(d)+(e)+(f) is less than about 20 weight %, most preferably less than about 15 weight %. These particles are preferably made according to the process described above.

The subject high active detergent particles can be used alone as a granular laundry detergent product or they can be admixed with other detergent ingredients to form a granular laundry detergent product. For example, the instant detergent particles can be admixed with spray-dried linear alkylbenzene sulfonate detergent particles to make a granular detergent product which cleans well. Alternatively, spray dried particles of linear alkylbenzene sulfonate and detergency builder can be admixed with the instant alkyl sulfate particles to make a good granular detergent product. The instant alkyl sulfate detergent particles are desirable in part because they provide a way to incorporate alkyl sulfate into granular detergents without having to spray dry. This avoids possible environmental problems attendant with spray drying alkyl sulfate. In addition, alkyl sulfuric acid is unstable and must be produced and neutralized at the spray drying site to avoid shipping relatively dilute water solutions. In contrast, linear alkylbenzene sulfonic acid is stable and readily obtainable for neutralization and spray drying. The instant alkyl sulfate particles which have been mechanically worked are a convenient way to boost alkyl sulfate content of concentrated granular detergent products without imparting a cold water dispersibility problem.

The following examples illustrate the compositions of the present invention. All parts, percentages and ratios herein are by weight unless otherwise specified.

EXAMPLE I

Sodium $C_{14-15}$ alkyl sulfate is obtained from a continuous neutralization loop (Chemithon Co., Seattle, Wash.) with separate incoming streams of $C_{14-15}$ alkyl sulfuric acid (made using $SO_3$ and $C_{14-15}$ fatty alcohol in a falling film reactor), sodium hydroxide solution which is 70% by weight of the hydroxide, and polyethylene glycol with a molecular weight of 8000. The neutralized paste contains 73% sodium alkyl sulfate, 11% water, and 9.6% polyethylene glycol 8000. The remainder is unreacted material, sulfate, and excess sodium hydroxide.

Room temperature neutralized paste is loaded into a three roll mill with the following setting.

| | ROLL RPM |
|---|---|
| Roll One | 20 |
| Roll Two | 40 |
| Roll Three | 60 |

Roll temperatures were held between about 21° C. and 24° C.

Final roll clearance is 0.006 inches (0.15 mm). Paste temperature is maintained during subsequent passes through the three roll mill at between 25° C. and 35° C.

The milled paste samples are allowed to cool overnight. About 20 kg. of milled paste is made. The samples of filled product are then ground in a Cuisinart® and the resulting particles are sieved through 14 on 65 Tyler mesh. A Black Fabric Deposition Test is then performed using the particles.

In the Black Fabric Deposition Test, the particles are introduced to a small scale washing machine containing 60° F. (15.5° C.) water at 7 grains per gallon hardness. Product concentration is approximately equal to that used in a real laundry situation. After agitation for 10 minutes, the wash solution is filtered through a 3½ inch (87.5 mm.) diameter circle of black fabric. The fabric is dried and graded on a 1 to 10 scale by panelists (blind test) for the amount of deposition observed. The panelists may vary about ½ grade. A grade of 10 reflects no visible specks of product and therefore excellent dispersibility of the particles in the cold wash water. Only a few particles are seen on the black fabric samples receiving a grade of 9, indicating very good dispersibility. A grade of 7 or 8 indicates acceptable dispersibility.

| Three Roll Mill Number of Passes | Black Fabric Deposition Grade |
|---|---|
| 0 | 5.0 |
| 1 | 7.5 |
| 2 | 8.5 |
| 3 | 9.0 |
| 4 | 9.0 |

Conclusion: Water dispersibility of sodium $C_{14-15}$ alkyl sulfate paste is significantly improved by passing the paste through a three roll mill 0.006 inch or 0.15 mm. final roll clearance) from 1 to 3 times.

The improved cold water dispersibility of the $C_{14-15}$ sodium alkyl sulfate is long-lasting, as is demonstrated by the following age test in which a two mill-pass sample is tested.

| Months of Aging at 90° F. (32.2° C.) | Black Fabric Deposition Grade |
|---|---|
| 0 | 8.5 |
| 1 | 8.5 |
| 2 | 8.5 |
| 3 | 9.0 |
| 4 | 9.0 |
| 5 | 9.0 |

EXAMPLE II

The cold water dispersibility of the sodium $C_{14-15}$ alkyl sulfate paste described in Example I is improved by extrusion in a ram piston extruder using an extruder plate having 1 mm openings. Samples are prepared and evaluated by a method similar to Example I. About 10 kg. of samples are made.

| Ram Extruder Number of Passes | Black Fabric Deposition Grade |
|---|---|
| 0 | 5.0 |
| 2 | 6.0 |
| 4 | 7.5 |
| 6 | 9.0 |

Elanco radial extrusion (1 mm. plate) of the same sodium $C_{14-15}$ alkyl sulfate paste under the same conditions as the ram piston extrusion shows similar improvements in cold water dispersibility. Paste temperature is maintained during subsequent passes through the extruder at between 20° C. and 40° C.

| Elanco Extrusion Number of Passes | Black Fabric Deposition Grade |
|---|---|
| 0 | 5.0 |
| 1 | 6.0 |
| 2 | 7.5 |
| 4 | 9.0 |
| 6 | 9.0 |

Conclusion: Cold water dispersibility of sodium $C_{14-15}$ alkyl sulfate paste is significantly improved by passing it through a ram piston extruder (1 mm. openings) from four to six times or an Elanco radial extruder (1 mm. plate) from two to four times.

EXAMPLE III

The importance of product moisture level to the improvement of cold water sodium $C_{14-15}$ alkyl sulfate particle dispersibility is demonstrated by mechanically working samples of sodium $C_{14-15}$ alkyl sulfate paste containing different moisture levels. In this test, about 2 kg. of sodium $C_{14-15}$ sodium alkyl sulfate paste is passed through the ram piston extruder used in Example II, and is prepared and evaluated by the method described in Example I. Along with the sodium $C_{14-15}$ alkyl sulfate and water levels cited below, the paste is made up of 6–7 weight % polyethylene glycol (molecular weight 8000) and smaller percentages of unreacted material, sulfate, and excess sodium hydroxide.

| Sample Number | Percent Sodium $C_{14-15}$ Alkyl Sulfate | Percent Moisture |
|---|---|---|
| 1 | 71.5 | 14.7 |
| 2 | 73.6 | 11.8 |
| 3 | 75.3 | 9.7 |
| 4 | 76.6 | 8.0 |

-continued

| Sample Number | Ram extruder Number of Passes | Black Fabric Deposition Grade |
|---|---|---|
| 1 | 0 | 4 |
| | 2 | 4 |
| | 4 | 4 |
| | 6 | 4 |
| 2 | 0 | 4.5 |
| | 2 | 7.0 |
| | 4 | 7.0 |
| | 6 | 7.0 |
| 3 | 0 | 5.0 |
| | 2 | 7.0 |
| | 4 | 8.5 |
| | 6 | 8.5 |
| 4 | 0 | 5.0 |
| | 2 | 9.5 |
| | 4 | 9.5 |
| | 6 | 9.5 |

Conclusion: Mechanical work by ram extrusion improves cold water dispersibility of sodium $C_{14-15}$ alkyl sulfate paste with water levels from 8 to 11.8 weight %, but does not affect cold water dispersibility of the paste with 14.7 weight % water.

EXAMPLE IV

The importance of paste temperature while applying mechanical work in improving sodium $C_{14-15}$ alkyl sulfate particle cold water dispersibility is demonstrated in the following example. About 2 kg. of sodium $C_{14-15}$ alkyl sulfate paste from the same run as that used in Example I is extruded in the ram piston extruder at ambient temperature and at 180° F. (82.2° C.). Samples are prepared and evaluated as in Example I.

| | Black Fabric Deposition Grade |
|---|---|
| Control sample (no extrusion passes) | 5.5 |
| Seven passes through extruder at ambient temperature | 9.5 |
| Seven passes through extruder at 180° F. (82.2° C.) | 5.5 |

Conclusion: $C_{14-15}$ alkyl sulfate paste temperature must be below 180° F. (82.2° C.) for mechanical work to improve cold water dispersibility.

what is claimed is:

1. A process for making high active detergent particles which are dispersible in water, comprising:

(a) producing a neutralized $C_{12-18}$ alkyl sulfate paste having less than about 14 weight % water and less than about 20 weight % additional ingredients by reacting in a continuous neutralization system $C_{12-18}$ alkyl sulfuric acid with an alkali metal hydroxide solution which is greater than or equal to about 62 weight % hydroxide;

(b) applying mechanical work by a roll mill, extruder, soap plodder, or combination thereof to said paste while maintaining said paste at temperatures between about 10° C. and 45° C.; and (c) forming detergent particles from said worked paste; said additional ingredients being selected from the group consisting of polyethylene glycol of a molecular weight between about 4,000 and 50,000; ethoxylated nonionic surfactant of the formula $R(OC_2H_4)_nOH$, wherein R is a $C_{12-18}$ alkyl group or a $C_{8-16}$ alkyl phenol group and n is from about 9 to about 80, with a melting point of greater than about 48° C; and mixtures thereof; and said mechanical work being applied in an amount sufficient to make said particles substantially disperse after agitation for about 10 minutes in water with a temperature between about 4° C. and 30° C.

2. A process according to claim 1 wherein said paste has from about 8 to 12 weight % water.

3. A process according to claim 2 wherein said neutralized $C_{12-18}$ alkyl sulfate paste comprises from about 5 to 10 weight % of said additional ingredients.

4. A process according to claim 3 wherein said mechanical work is applied in an amount sufficient to make said particles substantially disperse after agitation for about 10 minutes in water with a temperature between about 5° C. and 20° C.

5. A process according to claim 4 wherein said paste temperatures are maintained at between about 15° C. and 40° C. while applying said mechanical work.

6. A process according to claim 5 wherein said neutralized alkyl sulfate paste has between 14 and 16 carbon atoms and is produced in said continuous neutralization system by reacting $C_{14-16}$ alkyl sulfuric acid with sodium hydroxide solution which is about 70 weight % hydroxide.

7. A process according to claim 6 wherein said additional ingredient is polyethylene glycol of a molecular weight between about 7,000 and 12,000 and is added to said continuous neutralization system during neutralization.

8. A process according to claim 1 wherein said neutralized alkyl sulfate paste has a reserve alkalinity of between about 0.2% and 1.0% $Na_2O$ and is about 70 to 75 weight % active.

9. A process according to claim 8 wherein said mechanical work is done by one to three passes on a three roll mill at roll temperatures between about 20° C. and 27° C., roll revolutions per minute of about 20, 40 and 60, and final roll clearance between about 0.004 inches (0.1 mm.) and 0.008 (0.2 mm.) inches; and wherein said paste temperature is between about 25° C. and 35° C.

10. A process according to claim 8 wherein said mechanical work is done by four to six passes through a ram piston extruder with an extruder plate having 1 mm openings.

11. Detergent particles made according to the process of claim 1.

12. Detergent particles made according to the process of claim 9 which comprise:

(a) from about 70 to 75 weight % sodium $C_{14-16}$ alkyl sulfate;

(b) from about 8 to 12 weight % water;

(c) from about 5 to 10 weight % polyethylene glycol with a molecular weight between about 7,000 and 12,000;

(d) from 0 to about 6 weight % sodium hydroxide;

(e) from 0 to about 6 weight % unreacted material; and (f) from 0 to about 6 weight % sulfate; and wherein the total of (c)+(d)+(e)+(f) is less than about 20 weight %.

13. A method for washing fabrics at water temperatures between about 4° C. and 30° C. with high active detergent particles, said particles being made according to the process of claim 1 and being comprised of:

(a) from about 60 to 85 weight % neutralized $C_{12-18}$ alkyl sulfate;

(b) less than about 14 weight % water; and (c) less than about 20 weight % additional ingredients.

14. A method for washing fabrics at water temperatures between about 10° C. and 15° C., with high active detergent particles, said particles being made according to the process of claim 9 and being comprised of:

(a) from about 70 to 75 weight % sodium $C_{14-16}$ alkyl sulfate;

(b) from about 8 to 12 weight % water;

(c) from about 50 to 10 weight % polyethylene glycol of a molecular weight between about 7,000 and 12,000;

(d) from 0 to about 6 weight % sodium hydroxide;

(e) from 0 to about 6 weight % unreacted material; and (f) from 0 to about 6 weight % sulfate;

wherein the total of (c)+(d)+(e)+(f) is less than about 20 weight %.

* * * * *